US006003573A

United States Patent [19]

Owens

[11] Patent Number: 6,003,573

[45] Date of Patent: Dec. 21, 1999

[54] INTERCHANGEABLE PURSE ASSEMBLY

[76] Inventor: JoAnn Owens, 3346 Heatherwood La., Marietta, Ga. 30060

[21] Appl. No.: 08/953,969

[22] Filed: Oct. 20, 1997

[51] Int. Cl.[6] ..... A45C 1/02; A45C 13/02

[52] U.S. Cl. ..... 150/104; 150/106; 150/113; 383/111

[58] Field of Search ..... 150/103–106, 150/113, 118; 383/111; 190/110

[56] References Cited

U.S. PATENT DOCUMENTS

| | | | |
|---|---|---|---|
| 1,959,675 | 5/1934 | Hogg | 150/114 X |
| 1,960,396 | 5/1934 | Rosenberg | 150/105 |
| 1,999,669 | 4/1935 | Smith | 150/113 X |
| 2,183,428 | 12/1939 | McNary | 150/113 X |
| 2,311,847 | 2/1943 | Long | 383/111 X |
| 2,355,155 | 8/1944 | Greenfield | 150/104 |
| 2,413,465 | 12/1946 | Ohlsen | 150/118 |
| 2,437,382 | 3/1948 | Czap | 150/105 |
| 2,574,089 | 11/1951 | Cochran | 190/125 |
| 2,609,854 | 9/1952 | Rosen | 150/104 X |
| 2,612,199 | 9/1952 | Schocket | 150/106 X |
| 2,650,630 | 9/1953 | Mytinger | 150/104 X |
| 2,745,456 | 5/1956 | Rubin | 150/114 |
| 3,304,978 | 2/1967 | Gutterman et al. | 150/114 X |
| 3,414,033 | 12/1968 | Tucker | 150/104 |
| 3,533,459 | 10/1970 | Ody | 150/113 |
| 3,874,435 | 4/1975 | Allen | 150/114 X |
| 3,955,609 | 5/1976 | Siegel | 150/114 X |
| 3,958,616 | 5/1976 | Beverstock | 150/113 X |
| 4,260,004 | 4/1981 | Domke | 150/113 X |
| 4,263,951 | 4/1981 | Siegel | 150/106 X |
| 5,009,319 | 4/1991 | Jantzen | 150/104 X |
| 5,123,467 | 6/1992 | Steinberg | 150/106 |
| 5,207,254 | 5/1993 | Fromm | 150/104 |
| 5,413,199 | 5/1995 | Clement | 383/111 X |

FOREIGN PATENT DOCUMENTS

| | | | |
|---|---|---|---|
| 1171033 | 7/1984 | Canada | 150/113 |
| 1059597 | 3/1954 | France | 383/111 |
| 2629794 | 10/1989 | France | 150/103 |
| 2260894 | 5/1993 | United Kingdom | 150/105 |
| 9307777 | 4/1993 | WIPO | 150/105 |

OTHER PUBLICATIONS

Product Label, Suzan Briganti, "Push Up Bag"; San Francisco, CA.

*Primary Examiner*—Sue A. Weaver
*Attorney, Agent, or Firm*—Kenneth L Tolar

[57] ABSTRACT

The present invention relates to a purse assembly comprising a plurality of outer bag components each having a unique color or design. An interior pouch may be removably received within any one of the associated bag components by zipping the pouch onto the interior surface of the bag component side walls. Within the interior of the pouch and attached to a side thereof are a plurality of accessory storage devices such as a pen and pencil holder, a credit card holder, a photograph holder and a phone number/address book. Accordingly, items that are typically stored in a purse are placed in the removable pouch. When changing purse styles, a user would simply unzip the pouch and reattach it to another style bag component, thus eliminating the burdensome chore of having to individually transfer the items.

8 Claims, 2 Drawing Sheets

INTERCHANGEABLE PURSE ASSEMBLY

BACKGROUND OF THE INVENTION

The present invention relates to a ladies handbag or purse assembly comprising a plurality of exterior bag components each having a unique color or style which may be interchangably used in conjunction with a removably attached interior pouch. The interior pouch may be easily zipped into any one of the bag components such that a user may quickly and easily change purse styles or colors without having to individually transfer the contents from one purse to another. Furthermore, the removably attached interior pouch has a plurality of storage compartments configured to receive pens, pencils, photographs and credit cards.

DESCRIPTION OF THE PRIOR ART

Typically women have numerous handbags of varying colors and styles so that each may be used with a particular color wardrobe. When changing from one purse style to another, women must individually transfer items from the first purse to the second which is time consuming and laborious. Therefore, there is currently a need for a purse assembly which allows a user to quickly and easily convert from one style purse to another without having to individually remove the items stored therein.

Numerous handbags and purse designs exist in the prior art. However, none of these devices relate to a purse design having a plurality of purse components each having a unique color, style or size which may selectively receive a removably attached interior pouch. For example, U.S. Pat. No. 5,123,467 issued to Steinberg relates to a diaper bag having an electronic sound chip secured thereto. The sound chip is capable of emitting various sounds such as music upon actuation of a switch.

U.S. Pat. No. 3,955,609 issued to Siegel relates to a ladies handbag having an external flap on either side thereof. One flap opens to reveal various document storage pockets while the other has a plurality of transparent document enclosures on the interior side thereof.

U.S. Pat. No. 3,874,435 issued to Allen relates to a female business case comprising a flexible hollow purse like member open at the top with a top flap for removably closing the top opening. The purse like member has vertical sides with vertical folds permitting the member to be compressed or expanded between front and rear vertical surfaces.

U.S. Pat. No. 3,304,978 issued to Guterman et al relates to a purse having a plurality of compartments at least one of which is designed to expand laterally to accommodate storage of bulky items therein.

U.S. Pat. No. 2,745,456 issued to Rubin relates to a ladies pocketbook having a coin or cosmetic purse incorporated in the structure of the main bag.

U.S. Pat. No. 1,959,675 issued to Hogg relates to a pocketbook having an easily accessible cigarette holding compartment. As indicated above, none of the prior art handbags or purses have the features and advantages of the present invention especially the liner component which may be removably attached to any one of a number of corresponding, varying style outer bag components to overcome the disadvantages described above.

SUMMARY OF THE INVENTION

The present invention relates to a purse assembly comprising a plurality of outer bag components each having a unique style or color. Each outer bag component resembles a standard handbag with four substantially vertical side walls, a bottom wall, an open top and an interior chamber therebetween. Along the interior surface of three of the sidewalls of the bag component is a single unmatched substantially U-shaped zipper.

The device also comprises a removably attached substantially rectangular pouch component having two sides and four substantially planar peripheral edges. The top peripheral edge provides an access opening which may be selectively closed using a longitudinal zipper. On the exterior surface of two sides and a peripheral edge of the pouch proximal the top edge is a second single substantially U-shaped unmatched zipper for selectively engaging the zipper on the bag interior side wall. Accordingly, the pouch may be selectively zipped into any one of the bag components as desired.

Within the interior of each pouch component is a phone/address book, a photograph holder, a pen and pencil holder and a credit card holder. Accordingly, items typically stored within a purse may be neatly stored within the removable pouch. When a different purse style or color is desired, the user may easily remove the pouch from the bag component currently being used and zip it into the selected bag component without having to individually remove the items. It is therefore an object of the present invention to provide a purse assembly in which the style or color may be quickly and easily interchanged as desired.

It is yet another object of the present invention to provide a purse assembly having a detachable interior pouch that may be quickly and easily removed therefrom.

It is yet another object of the present invention to provide a purse assembly having a removably attached interior pouch which is capable of conveniently storing a plurality of accessory items such as pens, credit cards, an address book and photographs.

It is yet another object of the present invention to provide a purse assembly which allows a user to convert from one purse style to another without having to individually transfer the items stored therein. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
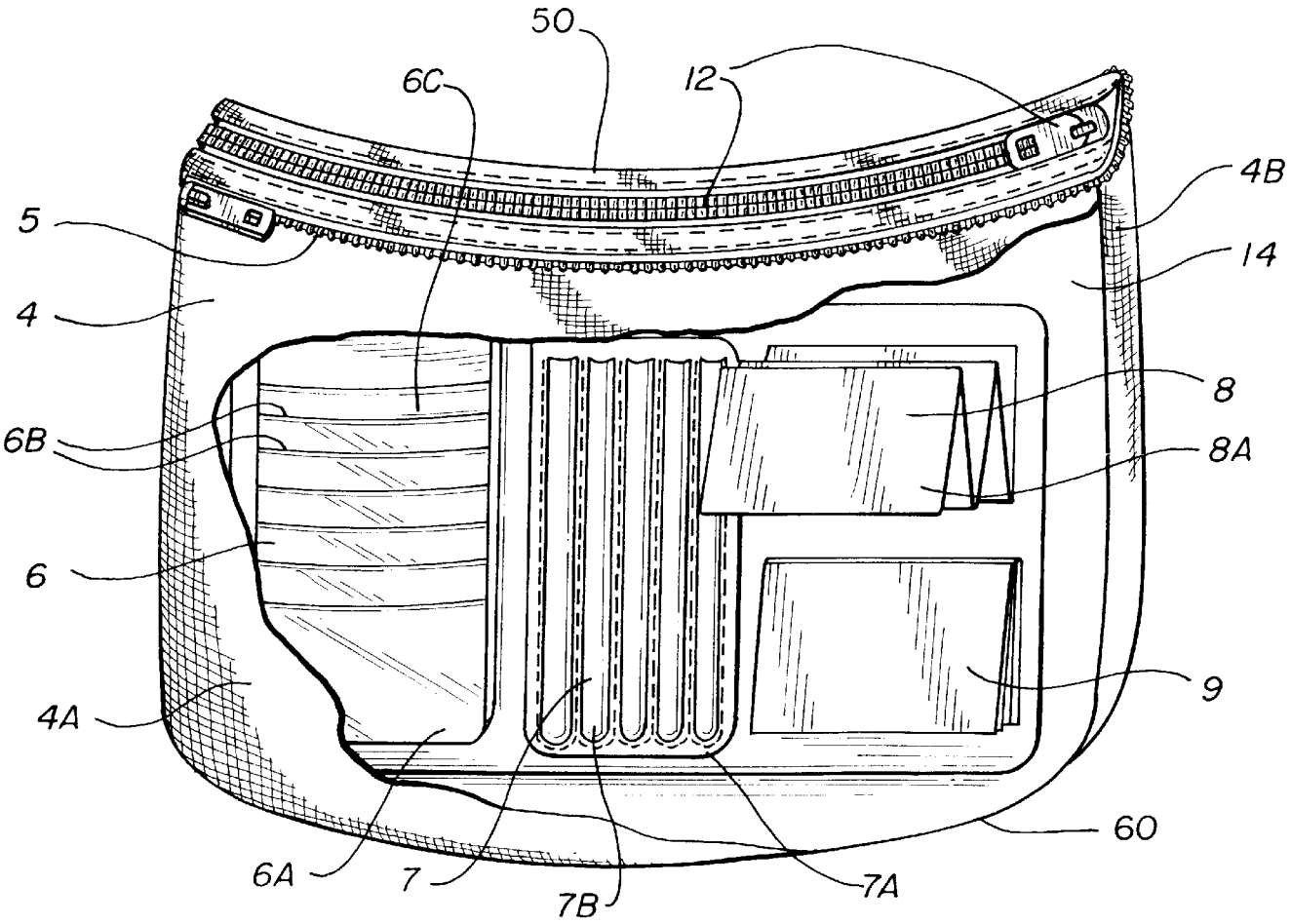
FIG. 1 is a cross sectional view of the interior pouch component depicting the credit card holder, pen and pencil holder, photograph holder and phone/address book.
Figure 2:
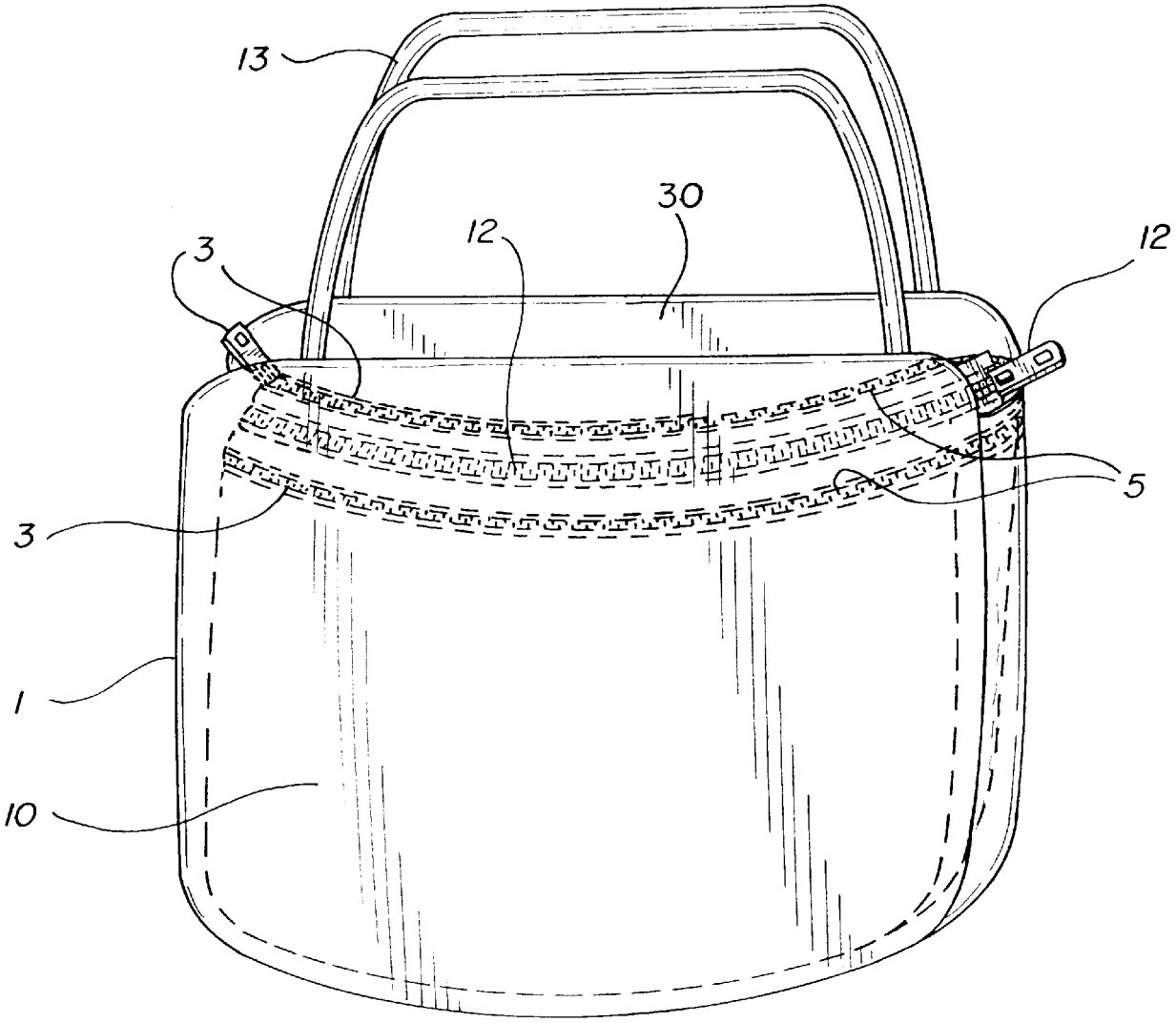
FIG. 2 depicts the inventive device with the interior pouch zipped into the purse component.

Referring now to FIGS. 1 through 2, the present invention relates to a ladies purse assembly comprising an exterior bag component 1 which resembles a typical purse of the type generally known in the prior art. The present invention is designed to provide an unlimited number of bag components 1 each having a unique color, design, shape or size. The bag component 1 comprises a bottom wall 11 and four side walls 10 vertically depending therefrom with an interior chamber formed therebetween. Between the two opposed longitudinal vertical side walls 10 opposite the bottom wall is an open top 12 providing access to the interior chamber. A substantially U-shaped handle 13 projects upwardly from an edge of each of the two opposed longitudinal side walls adjacent the access opening. Horizontally disposed along the interior surface of three side walls 10 of the bag component is a substantially U-shaped single unmatched zipper strand 3.

The device also comprises a substantially hollow interior pouch component 4 which is substantially rectangular with two opposing side walls 4A, two opposing vertical side edges 4B, a top edge 50, a bottom edge 60 and a pair of opposed side walls 70. Each pouch side wall has an interior and an exterior surface. The area between the peripheral edges and side walls define an interior storage compartment 14. The top peripheral edge provides an access opening to the interior compartment which may be selectively closed using a zipper 12. Disposed on the exterior surface of two side walls and a peripheral edge proximal the top peripheral edge is a single substantially U-shaped zipper strand 5 for selectively interlocking with the single strand zipper 3 on the interior surface of the bag component.

Within the interior compartment of the pouch component and attached to an interior side wall thereof are a credit card holder 6, a pen and pencil holder 7, a photograph holder 8 and a phone/address book 9. The credit card holder 6 is of the type generally found in a standard wallet and comprises a substantially rectangular panel 6A having a plurality of pockets 6B vertically arranged in an overlapping, tier like fashion each having an opening for receiving a credit card or similar object. The pockets 6B are formed with a plurality of flaps 6C each having four peripheral edges, three of which are permanently attached to the panel. The second flap overlays the first flap such that its unattached fourth peripheral edge provides the opening and is spaced a predetermined distance from the unattached peripheral edge of the first flap to form a credit card holding space. The remaining flaps are arranged in a similar manner.

The pen and pencil holder 7 comprises a substantially rectangular panel 7A attached to the pouch interior side wall having a plurality of substantially parallel hollow tubular compartments 7B with an open end each dimensioned to receive a pen or a pencil.

The photograph holder 8 is of the type generally known in the prior art and comprises a series of juxtaposed pockets 8A formed from a transparent material with integral fold lines therebetween each configured to receive a photograph or a similar document. Accordingly, the individual pockets may be folded and vertically stacked as depicted in FIG. 1. The phone/address book 9 resembles a standard pocket size phonebook having a pair of planar binders with a plurality of pages therebetween. One of the binders is attached to the interior surface of a pouch side wall.

Accordingly, all of the items typically stored in a standard handbag or purse are placed within the interior compartment of the pouch component. A desired style or color is selected and the interior pouch and any items therein are quickly zipped into the selected bag component.

As will be readily apparent to those skilled in the art, the scope of the invention is not limited to the exact details described above. For example, the interior pouch component may be secured to the bag component using buttons, Velcro®, snaps or any other suitable attachment means. Likewise, the interior pouch access opening may be selectively closed using any suitable attachment means. Furthermore, the pouch may have separate attachment means on both sides or on one or more peripheral edges. The size, shape, color and materials of construction of the various bag components as well as the interior pouch may be varied. The shape of the pouch component may also be varied. The bag components may also have various design elements imprinted or embossed thereon.

As described above, the present invention provides a purse assembly which allows a user to quickly and easily change purse styles, colors or sizes without having to individually remove the items stored therein. Although there has been shown and described the preferred embodiment of the present invention, it will be readily apparent to those skilled in the art that changes may be made thereto which do not exceed the scope of the appended claims. Accordingly the scope of the invention is only be limited by the following claims.

What is claimed is:

1. A purse assembly comprising:

a bag component having a bottom wall with four vertical side walls depending therefrom, said sidewalls each having an interior surface and a top terminal edge with an interior chamber formed between said bottom and side walls, said bag component having an opening defined by the area between the top terminal edges of said side walls allowing selective access to the interior chamber;

a first substantially U-shaped singular zipper strand attached to the interior surfaces of three of said bag component side walls;

a hollow pouch, said pouch removably received within said interior chamber of said bag component, said pouch being substantially rectangular with two opposing vertical side edges, a horizontal top edge, a horizontal bottom edge and two opposing side walls forming an interior compartment therebetween, the top horizontal edge being separable to provide access to the interior compartment;

a second substantially U-shaped singular zipper strand adjacent the top edge of the pouch and extending horizontally along the exterior surfaces of the two opposing side walls and a one of said vertical side edges of the pouch for selectively engaging said first U-shaped zipper strand on said bag component to seal the side walls and a first side edge of said pouch to three side walls of said bag component while the other vertical side edge of said pouch remains detached from said bag component.

2. A purse assembly according to claim 1 wherein said horizontal top edge of said pouch is separable with a zipper.

3. A purse assembly according to claim 2 wherein said pouch has a plurality of storage means received within said interior compartment and integrally attached to the interior surface of a side wall thereof.

4. A purse assembly according to claim 3 wherein one of said storage means comprises a plurality of pockets vertically arranged in an overlapping, tier like fashion each having an opening for receiving credit cards.

5. A purse assembly according to claim 4 wherein a second storage means comprises a plurality of juxtaposed pockets formed of transparent material with integral fold lines therebetween each having an access opening for receiving a photograph.

6. A purse assembly according to claim 5 wherein an address/phone book is received within the pouch interior compartment and is attached to a pouch side wall.

7. A purse assembly according to claim 6 wherein a third storage means comprises a panel attached to the interior surface of said pouch sidewall with a plurality of hollow elongated, tubular components attached to said panel, each having an open end for receiving a tubular instrument.

8. A purse assembly according to claim 1 wherein a handle is attached to the top terminal edges of two opposing side walls of the bag component, each on opposing sides of and adjacent to the opening.

* * * * *